US010035644B2

(12) United States Patent
Perrulli et al.

(10) Patent No.: US 10,035,644 B2
(45) Date of Patent: Jul. 31, 2018

(54) COMBINATION GLASS AND BOTTLE PACKAGE

(71) Applicant: govino, LLC, St. Helena, CA (US)

(72) Inventors: Joseph T. Perrulli, St. Helena, CA (US); Boyd I. Willat, Culver City, CA (US)

(73) Assignee: govino, LLC, Newport Beach, CA (US)

( * ) Notice: Subject to any disclaimer, the term of this patent is extended or adjusted under 35 U.S.C. 154(b) by 106 days.

(21) Appl. No.: 15/251,635

(22) Filed: Aug. 30, 2016

(65) Prior Publication Data

US 2017/0021992 A1 Jan. 26, 2017

Related U.S. Application Data

(63) Continuation-in-part of application No. 14/985,272, filed on Dec. 30, 2015, now Pat. No. 9,957,095,
(Continued)

(51) Int. Cl.
*B65D 77/00* (2006.01)
*B65D 85/72* (2006.01)
(Continued)

(52) U.S. Cl.
CPC ..... *B65D 85/72* (2013.01); *A47G 19/2205* (2013.01); *B65D 1/0261* (2013.01);
(Continued)

(58) Field of Classification Search
CPC ..... B65D 5/667; B65D 41/00; B65D 41/16; B65D 41/18; B65D 41/22; B65D 77/0493; B65D 1/0276; B65D 1/265; B65D 1/0261; B65D 41/04; B65D 41/26; B65D 75/002; B65D 85/72; B65D 1/0246; A47G 19/2205
(Continued)

(56) References Cited

U.S. PATENT DOCUMENTS 4,168,128 A * 9/1979 Fillmore ..... A45D 34/041 222/513
4,230,230 A * 10/1980 Mumford ..... B65D 41/18 215/277
(Continued)

FOREIGN PATENT DOCUMENTS

WO WO8905269 6/1989

*Primary Examiner* — Rafael Ortiz
(74) *Attorney, Agent, or Firm* — Lowry Blixseth LLP; Scott M. Lowry

(57) ABSTRACT

The combination package includes a beverage glass having an upper shell-shaped body defining an upwardly narrowing tapered flume of generally uniform thickness terminating in a smooth upper rim thereof defining an open mouth, and a lower base opposite the open mouth; and a bottle defining a container for retaining a beverage and a pour spout for dispensing the beverage therefrom, the bottle having a size and shape for select slide-in reception through the open mouth of the beverage glass in an inverted orientation such that the upwardly narrowing tapered flume selectively engages a sidewall of the container for friction-fit engagement therewith, wherein engagement of the bottle with the beverage glass forms the combination package.

35 Claims, 13 Drawing Sheets

Related U.S. Application Data which is a continuation of application No. 12/939,658, filed on Nov. 4, 2010, now Pat. No. 9,227,772.

(60) Provisional application No. 61/266,210, filed on Dec. 3, 2009.

(51) Int. Cl.

| | |
|---|---|
| ***A47G 19/22*** | (2006.01) |
| ***B65D 75/00*** | (2006.01) |
| ***B65D 77/04*** | (2006.01) |
| ***B65D 1/26*** | (2006.01) |
| ***B65D 41/04*** | (2006.01) |
| ***B65D 41/26*** | (2006.01) |
| *B65D 1/02* | (2006.01) |

(52) U.S. Cl.

CPC ..... *B65D 1/265* (2013.01); *B65D 41/04* (2013.01); *B65D 41/26* (2013.01); *B65D 75/002* (2013.01); *B65D 77/0493* (2013.01); *B65D 1/0246* (2013.01)

(58) Field of Classification Search

USPC ..... 206/217, 218, 216, 497, 499, 502; 215/387, 393, 395, DIG. 7, DIG. 37; 220/699, 703

See application file for complete search history.

(56) References Cited

U.S. PATENT DOCUMENTS

| | | | | |
|---|---|---|---|---|
| 4,273,247 | A * | 6/1981 | Earls | B65D 41/26 141/380 |
| 4,544,073 | A * | 10/1985 | Willis | B65D 51/18 215/12.1 |
| 4,630,742 | A * | 12/1986 | Miyaji | A47J 41/0016 215/12.1 |
| 4,693,410 | A * | 9/1987 | Selz | A47G 19/2205 215/228 |
| 5,269,426 | A * | 12/1993 | Morano | A61J 11/008 215/11.6 |
| 6,662,959 | B1 | 12/2003 | Westerhold | |
| 6,904,867 | B2 * | 6/2005 | Zamjahn | G09F 11/23 116/308 |
| 7,273,147 | B2 | 9/2007 | Willat et al. | |
| 7,296,700 | B2 | 11/2007 | Steele et al. | |
| 7,404,345 | B1 * | 7/2008 | Dipprey | B67B 7/16 81/3.09 |
| D577,547 | S | 9/2008 | Willat et al. | |
| 2005/0039416 | A1 | 2/2005 | Hidding | |
| 2005/0092760 | A1 | 5/2005 | Westerhold | |
| 2007/0119726 | A1 | 5/2007 | Willat et al. | |
| 2007/0144932 | A1 | 6/2007 | Willat et al. | |
| 2008/0011706 | A1 | 1/2008 | Downing et al. | |
| 2008/0264958 | A1 * | 10/2008 | Blake | B65D 41/3447 220/703 |

* cited by examiner

COMBINATION GLASS AND BOTTLE PACKAGE

BACKGROUND OF THE INVENTION

The present invention relates generally to a combination glass and bottle package. More specifically, the present invention relates to a wine glass configured for select slide-fit engagement with a bottle containing wine or another select beverage, the combination forming a compact and convenient single transportable package wherein the glass may be detached from the bottle, and the select beverage poured into the glass for consumption and enjoyment.

A commercial unit or package that includes a drinking vessel such as a glass in combination with a beverage-containing bottle is, in general, known in the art. For example, WIPO Publication No. WO8905269 to Hickinbotham discloses a wine glass or cup positioned in an inverted orientation atop a wine bottle or the like, with the glass or cup including an internal cap portion or segment adapted to sealingly fit with and close the bottle. To open the bottle, the inverted glass or cup is rotatably removed from the bottle, whereupon the bottle contents can be poured directly into the glass or cup for consumer enjoyment. The glass or cup and the bottle are preferably formed from a molded plastic material selected for oxygen imperviousness, thereby safeguarding the bottle contents against oxygen ingress and resultant degradation.

The combination package disclosed by Hickinbotham exhibits a number of commercial drawbacks or disadvantages, whereby the combination package has not achieved broad market acceptance or use. For example, the combination package disclosed in Hickinbotham relies upon direct sealing engagement between the glass or cup and the beverage-containing bottle. The glass or cup has a wine glass shape having a receptacle supported at the upper end of an elongated stem which projects upwardly from a relatively broad base, with the sealing cap segment formed in the bottom of the receptacle. As a result, the elongated stem and base of the glass or cup extend, when inverted, above the bottle to provide a combination package that is relatively tall. This tall package, while constructed from plastic and thus relatively lightweight, is not conducive to convenient shipping, handling, or storage, without significant risk of bumping the glass or cup sufficiently to break the bottle seal, and thereby allow the bottle contents to spoil.

Additional disadvantages include the non-tapering or non-flumed geometry of the wine glass such that Hickinbotham fails to achieve a relatively minimal package width, especially along the neck of the bottle. Moreover, the straight or common diameter width of the wine glass is also prone to more spillage than a wine glass with a tapered or flumed geometry. Furthermore, the wine glass has a volumetric capacity that is significantly less than the volumetric capacity of the bottle, whereby all wine in the bottle cannot be poured in the glass in a single pour. Instead, the consumer must retain the now-open bottle of wine with residual wine therein, and wait until at least part of the wine is consumed from the glass before the residual wine can be poured into the glass.

In another example, U.S. Pat. No. 4,230,230 to Mumford discloses a cup-shaped cap that attaches to the top of a relatively larger bottle. The cap includes a plurality of inwardly projecting ribs on the inside of the cap walls, which generally diverge from the base to an upper rim. The inwardly projecting ribs are particular important as they facilitate stacking of multiple caps within one another, to prevent one cap from becoming wedged to another cap. The drawback here is that the caps cannot be made from an extrusion or blow molding process wherein the cap walls have a generally uniform thickness, or an upwardly tapering flume that may be desired for enhanced olfactory enjoyment of beverages like red or white wine. Moreover, Mumford is also undesired for single-serve applications since the cap is too small to selectively receive the entire volumetric capacity of the bottle contents. Additionally, the Mumford cap requires a plurality of protruding lugs extending out from the upper lip or rim to facilitate snap-fit attachment of the cap with the bottle. Such lugs are particular intrusive when drinking wine or other related beverages since the upper lip or rim is not smooth.

In another reference, U.S. Pat. No. 4,273,247 to Earls discloses a cup-shaped closure cap that includes an upwardly projecting attachment mechanism disposed in the interior of the cap and is configured to engage the bottle cap or pour spout. Like Mumford, the Earls cap cannot be made from an extrusion or blow molding process wherein the cap walls have a generally uniform thickness, including a flat central component, or an upwardly tapering flume that may be desired for enhanced olfactory enjoyment of beverages like red or white wine. Instead, the Earls cup is upwardly diverging and includes an interiorly disposed cylindrical cup collar therein. This cylindrical cup collar is needed to engage the cap with the bottle via threaded or snap-fit connectors. Also, since the collar protrudes into the interior volume of the cap, it inhibits any potential for freely swirling wine or another beverage therein. Again, the volumetric capacity of the Earls bottle is relatively larger than that of the disclosed cap, which inhibits single-serve applications.

Moreover, U.S. Pat. No. 4,544,073 to Willis discloses the combination of a bottle and overcap that present a unitary uninterrupted cylindrical appearance when combined. Willis fails to disclose a glass or overcap having an upwardly tapered flume, and doing so would be contrary to the purpose of providing a combination that resembles a unitary cylinder. The bottle also has a greater volumetric capacity than the cap, thus inhibiting use in single-serve applications. Willis also undesirably attaches the cap to the larger bottle via an internally disposed circumferential protrusion, which inhibits the cap from having a generally uniform thickness and otherwise creates a protruding ridge that interrupts fluid consumption from the cap.

Additionally, U.S. Pat. No. 4,693,410 to Selz discloses a drinking cup that, like Earls, attaches to the top of a bottle in place of a sealing cap, and includes an internally disposed attachment mechanism within the cap. In this respect, the Selz cap cannot include a cup body made from an extrusion or blow molding process to form a generally uniform thickness wall or narrowing tapered flume. Instead, the cup upwardly diverges and even includes an outwardly presented rim or lip that extends away from the bottle outer wall. Another drawback of Selz is that the bottom in the cup includes the annular collared closure. Every time the bottle is sealed, a consumer must either use the entire cup as a cap, or remove the transparent bottom portion containing the sealing mechanism, eliminating reuse of the cup for future beverage consumption. The collared closure also interferes with spinning beverage (e.g., wine) therein, by way of its connection mechanism being disposed internally, as opposed to the bottle outer wall, which limits the potential enjoyment of beverages like wine.

There exists, therefore, a significant need in the art for an improved glass and bottle combination wherein a glass or cup, such as a wine glass, is combined with a beverage-containing bottle, such as a wine bottle, in a compact and stable configuration for safeguarding the bottle contents against inadvertent opening and spoilage, while further providing for convenient portability, and full enjoyment of the entire contents of the beverage bottle using the attached glass or cup. The present invention fulfills these needs and provides further related advantages.

SUMMARY OF THE INVENTION

One embodiment of a combination package as disclosed herein includes a beverage glass having an upper shell-shaped body defining an upwardly narrowing tapered flume of generally uniform thickness terminating in a smooth upper rim thereof defining an open mouth, and a lower base opposite the open mouth. Furthermore, the combination includes a bottle defining a container for retaining a beverage and having a pour spout for dispensing the beverage therefrom. The bottle may have a size and shape for select slide-in reception through the open mouth of the beverage glass in an inverted orientation such that the upwardly narrowing tapered flume selectively engages a sidewall of the container for friction-fit engagement therewith. The engagement of the bottle with the beverage glass forms the combination package. Preferably, the beverage glass volume is relatively larger than the bottle volume.

In another aspect of this embodiment, the bottle may include a notched indent and/or a detent protrusion at least partially disposed around the circumference of the bottle. In this respect, the detent protrusion may include a continuous circumferential external detent extending around the outer circumference of the bottle, or a plurality of outwardly presented discrete detent sections disposed intermittently (e.g., evenly spaced) around the outer circumference of the bottle. The bottle may further include a slant adjacent to and increasing in diameter away from the detent protrusion and toward a bottom of the bottle. The slant may extend outwardly at an angle between 10 and 20 degrees relative to the vertical central axis of the bottle. When the bottle engages the beverage glass, the smooth upper rim of the beverage glass may twice contact the bottle, a first contact being over the detent protrusion and a second contact being inwardly against the slant. Alternatively, the bottle outer wall may include only the slant. Here, the glass upper rim contacts the slant for friction or interference engagement therewith. In another alternative aspect of this embodiment, the bottle outer wall may include a constant outer diameter such that an upper rim having a vertical upper lip engages the constant outer diameter wall of the bottle, as opposed to the slant and/or the detent protrusion(s).

In another aspect of the combination, the bottom of the bottle may include an outer diameter relatively larger than the open mouth. In this respect, the bottom of the bottle closes off the open mouth when the bottle is seated within the beverage glass. The bottle bottom may also include a step or transitional stop between the container and the bottom. The step or stop selectively engages the smooth upper rim to terminate slide-in engagement of the bottle into the beverage glass at a desired distance. For example, the bottle may terminate at a position where a cap selectively engaged to and closing the pour spout has a relatively flat-topped configuration that seats flush within a flat central component having a smooth inner surface formed concentric within an upstanding punt surrounded by a recessed annular moat.

Furthermore, the smooth upper rim may include a radially outwardly extending upper lip disposed above an outwardly-presented recess formed above the inwardly narrowing tapered flume. A seal member that may include a shrink-wrap film may be wrapped around the beverage glass and the bottle and at least partially disposed within the outwardly-presented recess. The seal member is designed to encompass the beverage glass and bottle and may be selectively removable to permit access to and removal of the bottle from the beverage glass. The upper shell-shaped body may taper into the lower base having a diameter relatively smaller than the largest outside diameter of the upper shell-shaped body. The beverage glass may also include a non-circumferential notched indent defining an upwardly-presented exterior shelf. Here, the non-circumferential notched indent may inwardly project into the beverage glass and contact a portion of the bottle sidewall when the bottle seats within the beverage glass. The beverage glass may be formed in the shape of a truncated spheroid.

In another embodiment of the combination package disclosed herein, the beverage glass may have an upper shell-shaped body defining an upwardly narrowing tapered flume of generally uniform thickness terminating in a smooth upper rim thereof defining an open mouth, and a lower base opposite the open mouth. The combination may further include a bottle defining a container for retaining a beverage, a pour spout for dispensing the beverage therefrom, and a detent protrusion at least partially disposed around the circumference of the bottle. The bottle may be of a size and shape for select slide-in reception through the open mouth of the beverage glass in an inverted orientation only so far as the smooth upper rim contacts an outwardly protruding step terminating slide-in engagement of the bottle into the beverage glass. Thus, when the bottle is engaged with the beverage glass thereby forming the combination package, the smooth upper rim at least partially engages the detent protrusion for friction-fit engagement therewith. A relatively larger diameter bottom closes the open mouth when the bottle is seated within the beverage glass.

In one embodiment, the detent protrusion may include a continuous circumferential external detent or a plurality of outwardly presented discrete detent sections. The bottle may also include a slant adjacent to and increasing in diameter away from the detent protrusion and toward the bottom of the bottle. In one embodiment, the slant may diverge away from the central vertical axis of the inverted bottle by an angle between 10 and 20 degrees. Thus, when the bottle is engaged with the beverage glass, the smooth upper rim of the beverage glass may twice contact the bottle, a first contact being over the detent protrusion and a second contact being against the slant. More specifically in this respect, the smooth upper rim may include a radially outwardly extending upper lip disposed above an outwardly-presented recess formed above the inwardly narrowing tapered flume and the upper shell-shaped body may taper into the lower base having a diameter relatively smaller than the largest outside diameter of the upper shell-shaped body. Here, the upwardly narrowing tapered flume may provide the first contact with the detent protrusion and the outwardly-presented recess may provide the second contact with the bottle slant.

In another aspect of this embodiment, a seal member that includes a shrink-wrap film may wrap around the beverage glass and the bottle and be at least partially disposed within the outwardly-presented recess. The seal member may be selectively removable to permit access to and removal of the bottle from the beverage glass. For single-serve applications, the beverage glass volume may be relatively larger than the bottle volume so the entire beverage contents of the bottle may be dispensed into the beverage glass after the shrink-wrap film and bottle cap are removed. The beverage glass may also be in the shape of a truncated spheroid and include a non-circumferential notched indent defining an upwardly-presented exterior shelf. The non-circumferential notched indent may project inwardly into the beverage glass and contact a portion of the bottle when the bottle is seated within the beverage glass. Furthermore, the lower base may include an upstanding punt surrounded by a recessed annular moat circumscribing a relatively flat central component having a smooth inner surface. In one embodiment, the bottle may include a cap that selectively engages with and closes the pour spout. The cap may include a relatively flat-topped configuration so the cap can seat flush with the flat central component. Additionally, the bottle may include an elliptically-shaped notched indent having a relatively smooth and outwardly presented concave surface.

In another combination package as disclosed herein, a beverage glass having an upper shell-shaped body defining an upwardly narrowing tapered flume of generally uniform thickness may terminate at one end in a smooth upper rim defining an open mouth and taper at another end into a lower base having a diameter relatively smaller than the largest outside diameter of the upper shell-shaped body. Furthermore, the smooth upper rim may include a radially outwardly extending upper lip disposed above an outwardly-presented recess formed above the inwardly narrowing tapered flume. The combination may further include a bottle defining a container for retaining a beverage and including a slant increasing in diameter toward a bottom of the bottle, and a pour spout for dispensing the beverage therefrom. The bottle may include a notched indent having a wall thickness approximately the same thickness as the rest of the bottle and may have a size and shape for select slide-in reception through the open mouth of the beverage glass in an inverted orientation such that the upwardly narrowing tapered flume selectively engages a sidewall of the container for friction-fit engagement. Engagement of the bottle with the beverage glass forms the combination package.

In another aspect of this embodiment, the bottle may include a detent protrusion at least partially disposed around the circumference of the bottle and the slant may be adjacent to and increase in diameter away from the detent protrusion and toward a bottom of the bottle, which includes an outer diameter relatively larger than the open mouth. As such, the bottle bottom closes the open mouth when the bottle is seated within the beverage glass. The detent protrusion may include a continuous circumferential external detent or a plurality of outwardly presented discrete detent sections and the slant may include an angle between 10 and 20 degrees. When the bottle is engaged with the beverage glass, the smooth upper rim of the beverage glass may twice contact the bottle, a first contact being over the detent protrusion and a second contact being against the slant.

A seal member that includes a shrink-wrap film may wrap around the beverage glass and the bottle and be at least partially disposed within the outwardly-presented recess. The seal member may be selectively removable to permit access to and removal of the bottle from the beverage glass. Additionally, the beverage glass may further include a non-circumferential notched indent defining an upwardly-presented exterior shelf. The non-circumferential notched indent may project inwardly into the beverage glass and contact a portion of the bottle when the bottle is seated within the beverage glass. Preferably, the beverage glass volume is relatively larger than the bottle volume. Additionally, the lower base may include an upstanding punt surrounded by a recessed annular moat circumscribing a relatively flat central component having a smooth inner surface and the bottle may include a cap selectively engaged to and closing the pour spout. The cap may include a relatively flat-topped configuration for flush seating within the flat central component. Lastly, the bottle may include a step that selectively engages the smooth upper rim to terminate slide-in engagement of the bottle into the beverage glass.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 2:
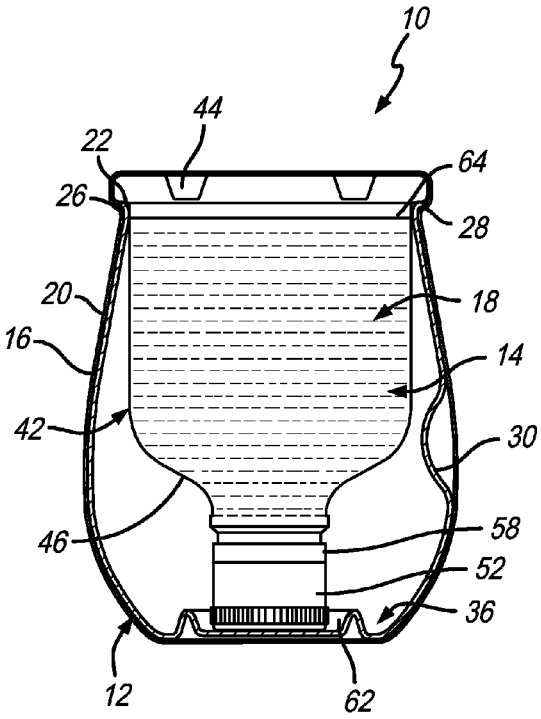
FIG. 2 is a vertical sectional view of the glass of FIG. 1 having one embodiment of an inverted bottle received therein to provide the combination glass and bottle as disclosed herein.

As shown in the exemplary drawings purposes of illustration, one embodiment of a combination package is referred to generally by the reference numeral 10 in FIG. 2. More specifically, FIG. 2 illustrates the package 10 generally including a glass 12 having a size and shape to selectively receive and retain a bottle 14 therein. The glass 12 may be constructed from a unitary molded plastic material such as by way of extrusion molding, blow molding, or the like, such as PET plastic or BPA-free plastic. Although, of course, the glass 12 could be made from other materials known in the art, such as glass, metal, etc. Similarly, the bottle 14 is preferably made from a plastic material such as by way of extrusion molding, blow molding, or the like, or the bottle 14 could be made from other materials known in the art designed to seal and retain beverages therein over some desired duration (e.g., glass). In one embodiment, the glass 12 may have a unitary or one-piece construction adapted to receive and support the bottle 14 in an inverted orientation substantially within the glass 12, as shown in FIG. 2. The package 10 including the glass 12 and the bottle 14 may be assembled and maintained in a single unitized commercial unit in a sanitary or sterilized condition by surrounding the combination with an external wrap or seal 16 (FIG. 2) in the form of a shrink-wrap film or the like.

Figure 1:
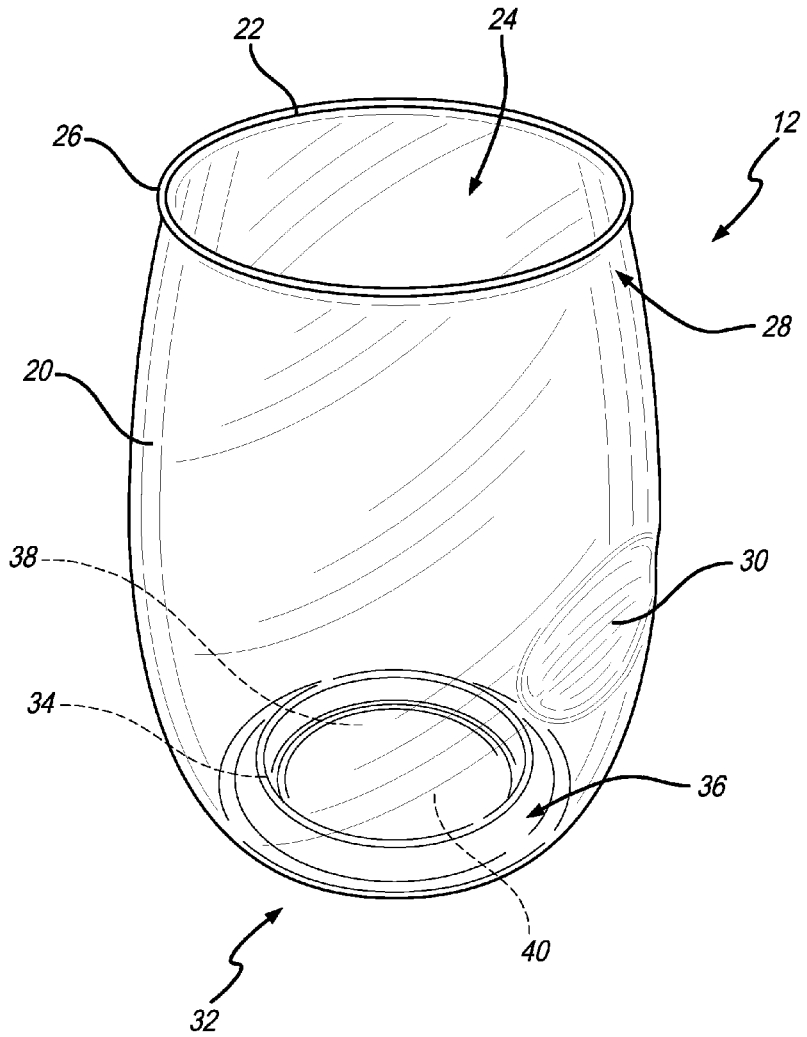
FIG. 1 is a perspective view illustrating one embodiment of a glass for use as part of a combination glass and bottle as disclosed herein.

One glass 12 for use with the combination package 10 disclosed herein is illustrated more specifically in FIG. 1. Here, the glass 12 is shown formed with a geometric shape designed to enhance enjoyment of substantially the full range of characteristics attributable to a beverage 18, such as wine or the like. The glass 12 includes an upper flume or body 20 of upwardly narrowing or upwardly converging cross sectional size having a generally uniform thickness and smooth contoured geometry that may be used to concentrate wine aroma or bouquet near the top. The upper body 20 terminates in an upper rim 22 defining a generally circular open mouth 24 sized to selectively receive the bottle 14 therein. The rim 22, in one embodiment, may include an arced configuration that includes an outwardly radiating upper lip 26 disposed immediately above a relatively shallow indent 28. A notched indent 30 (e.g., non-circumferential or circumferential) may be formed in the upper body 20 in at least one side thereof (or circumferentially), such as at a generally centered vertical location as shown in FIGS. 1-4. In the embodiment shown in FIGS. 1-4, the upper body 20 generally tapers inwardly toward a lower base 32 opposite the upper rim 22. The lower base 32 may include a contour that defines an upstanding punt 34 surrounded by a recessed annular moat 36 circumscribing a central component 38 such as the illustrative bowl or cup region having a relatively flat bottom wall 40. Further details of the construction and configuration of the glass 12 are generally shown in U.S. Pat. Nos. 8,567,635, 7,273,147, and D577,547, and U.S. Publication No. 2007/0119726, the contents of which are all herein incorporated by reference in their entirety.

The glass 12 may include alternative configurations such as, e.g., a filled in lower base 32 whereby the volume under the punt 34 and the central component 38 are filled in with material (e.g., plastic) to make the glass 12 more bottom heavy for purposes of lowering the center of gravity. Additionally, the lower base 32 may not include the upstanding punt 34 and/or the central component 38. In this embodiment, the lower base 32 may be flat such that the bottom wall 40 provides support for the glass 12, as opposed to being formed as part of the contoured lower base 32 and projecting upwardly as formed integral with the upstanding punt 34.

Additionally, the bottle 14 may be of a size and shape to selectively retain a quantity of the beverage 18 (e.g., wine) in a single serving amount. Here, bottle 14 and the glass 12 may be assembled into a stable and secure commercial package 10 suitable for providing a single serving of the beverage 18. As such, in another aspect, the bottle 14 may be constructed from a gas-impervious material such as glass or a suitable molded plastic material selected to prolong the shelf life of the beverage 18 stored therein, without adversely impacting the stability or security of the package 10.

Figure 3:
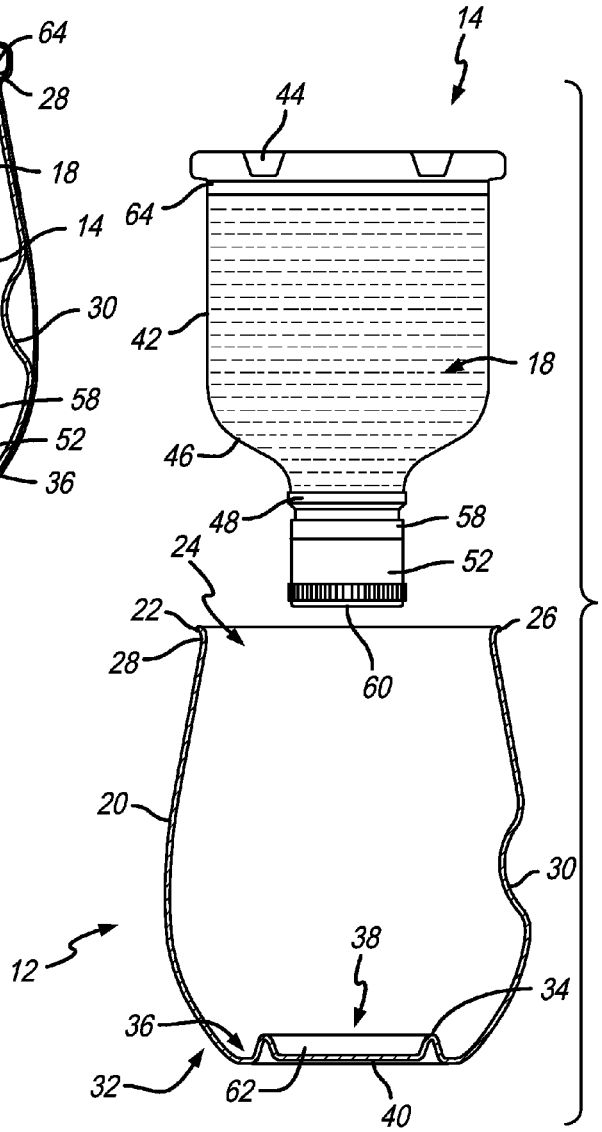
FIG. 3 is an exploded sectional view similar to FIG. 2, illustrating the inverted bottle removed from the glass of FIG. 1.
Figure 4:
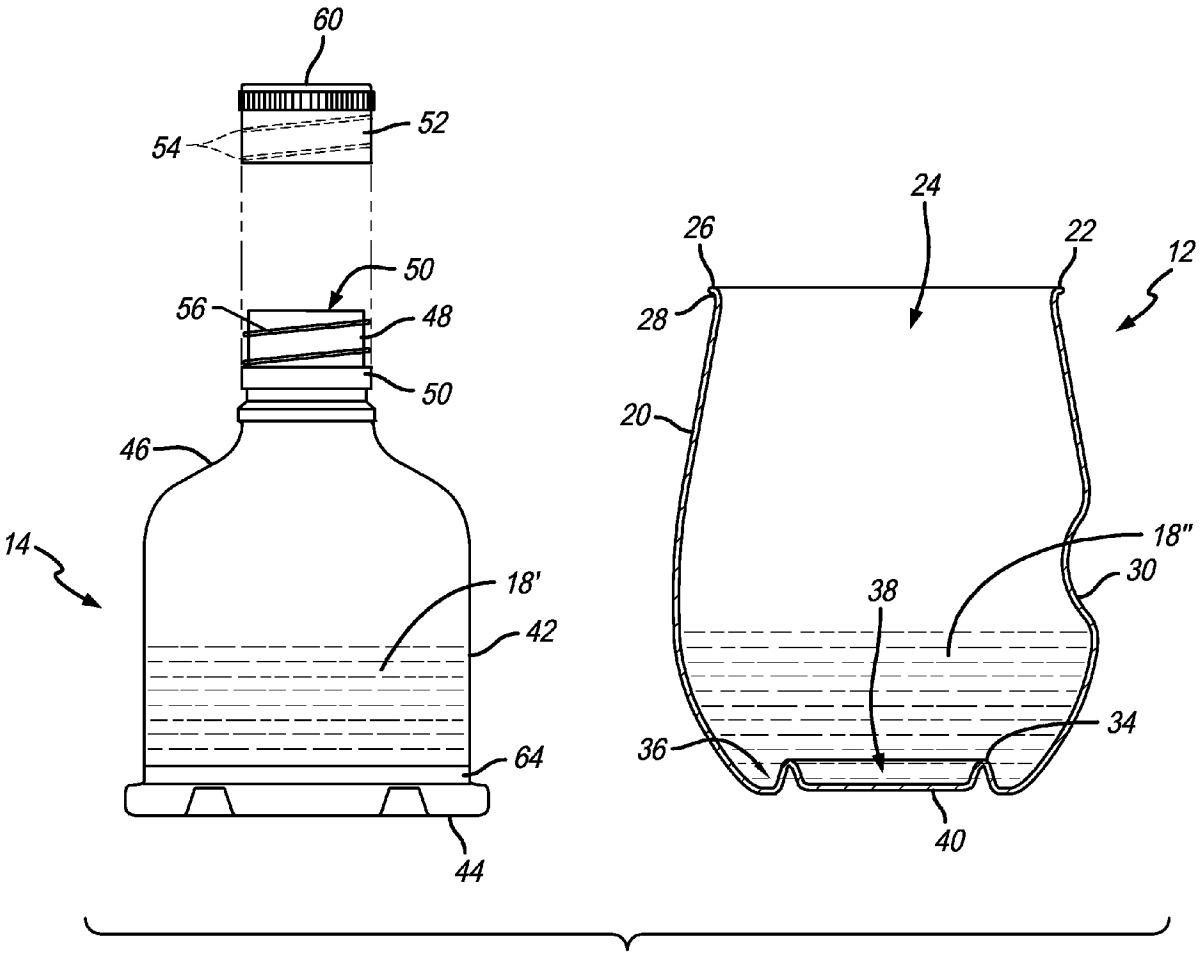
FIG. 4 is an exploded perspective view similar to FIGS. 2 and 3, further illustrating the bottle in an open condition with a portion of the beverage contents thereof poured into the glass.

As shown in FIGS. 2-4, the bottle 14, in one embodiment, may include a relatively consistent diameter cylindrical body 42 having a smooth exterior profile parallel to the central axis and that includes a lower base 44 at one end and, at the other end, an upper narrowing shoulder 46 which terminates in turn into a relatively smaller diameter neck 48 defining a pour spout 50 for pouring the beverage 18 out from the bottle 14 and into, e.g., the glass 12. Alternatively, the shoulder 46 and the neck 48 may be approximately the same diameter as the body 42, which may lower the center of gravity to the middle or lower third of the package 10 and also provide a greater volume for storing the beverage 18 therein. A conventional cap 52 may be formed from plastic, metal, or another material known in the art, and be used to close the pour spout 50 and enclose or cover an internal sealing mechanism, such as a plastic or foil sheet material (not shown) that seals closed the spout 50.

In one embodiment, the cap 52 may couple or mount to the bottle neck 48 by way of inter-engaging threads. More specifically, for example, the embodiment disclosed in FIG. 4 illustrates the cap 52 including a set of internal threads 54 that selectively rotatably engage a set of external threads 56 on the exterior of the bottle neck 48. The cap 52 may also include a base ring 58 adapted for frangible separation from the cap 52 upon removal of the cap 52 from the bottle neck 48. Persons skilled in the art will recognize and appreciate that alternative caps and related sealing mechanisms may be employed with the embodiments disclosed herein, such as pull-tabs, stay-on-tabs, press-fit cork stoppers, etc.

Figure 12:
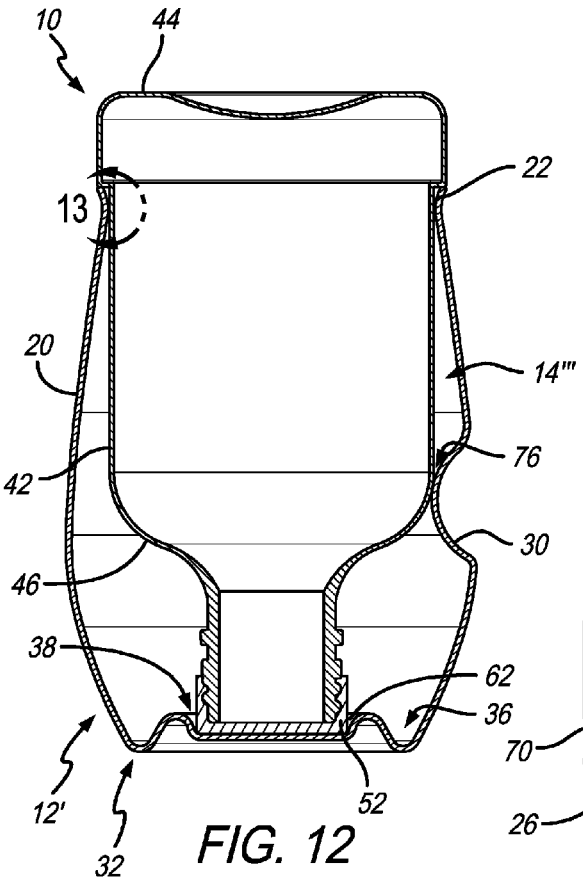
FIG. 12 is a vertical sectional view of the inverted bottle of FIG. 11 inserted within a glass as disclosed herein.

The cap 52 may be of a size and shape to have a substantially flat top 60 for substantially nested reception seated within the flat-bottomed central component 38 at the bottom of the glass 12, when the bottle 14 is placed into the glass 12 in an inverted orientation as shown in FIGS. 2 and 3. In this position, the upstanding annular punt 34 and the moat 36 circumscribe the cap 52 as shown best in FIG. 2. Here, the cap 52 may be offset from the punt 34. In particular, an internal surface 62 of the punt 34 may include a relatively smooth geometry that is otherwise free of projections that could interfere with or otherwise engage the downwardly positioned cap 52. In the inverted position shown in FIGS. 2 and 3, the neck 48, the shoulder 46, and the body 42 are preferably of a size and shape to fit within the interior of the glass 12 in nested relation therein (FIG. 2). The lower base 44 of the bottle 14 is also of a size and shape to extend across and essentially close the mouth 24 of the glass 12. Moreover, as shown best in FIG. 2, the bottle 14 further includes a shallow recessed groove 64 at or near the bottom of the body 42 (e.g., the juncture between the body 42 and the lower base 44), for substantial interference fit reception of the upper rim 22 of the glass 12. In one embodiment, the bottle 14 is secured in a safe and stable manner, nested substantially within the interior cavity of the glass 12, only by way of interference fit engagement of the rim 22 with the recessed groove 64. In an alternative embodiment, the bottle 14 may be inverted within the glass 12 for seated reception therein, wherein the cap 52 rests on the flat central component 38 to provide a second contact point for securing the bottle 14 within the glass 12 (FIG. 12).

As briefly mentioned above, the assembly of the glass 12 and the bottle 14 into the package 10 best shown in FIG. 2 may, if desired, be encased within the external seal 16, such as plastic shrink-wrap film or the like to keep the glass 12 clean and ready for use before the package 10 is opened. The seal 16 may also serve the purpose of providing a space for brand placement or listing instructions for use or disassembly of the package 10. As shown in FIG. 2, the external seal 16 may be drawn into the recessed groove 64 just below the upper lip 26 of the arced glass upper rim 22, to assist in retaining the glass 12 and bottle 14 in the desired assembled relation.

FIG. 3 illustrates disassembly of the inverted bottle 14 from the glass 12, subsequent to removal of the external seal 16. Furthermore, FIG. 4 illustrates the bottle 14 with the cap 52 removed to expose a portion of the beverage 18' contained within the bottle 14. Here, a portion of the beverage 18' remains in the bottle 14, while another portion of the beverage 18" has been poured into the interior of the glass 12. In this respect, with the cap 52 removed, the remaining beverage 18' can be quickly and easily poured to empty the entire contents of the bottle 14 into the upright glass 12 for examination and drinking enjoyment.

In one embodiment, in a single serving size, the glass 12 may have a volumetric capacity of about 350 milliliters ("ml"), and the bottle 14 may have a volumetric capacity of about 187 ml. In this regard, and as shown in FIG. 2, the bottle 14 may include sufficient unoccupied volume or "head" space, whereby the level of the beverage 18 is below the rim 22 of the glass 12, when the bottle 14 is assembled in an inverted orientation within the glass 12. Of course, the glass 12 and the bottle 14 may be of virtually any volumetric size as needed or desired. Although, preferably, the glass 12 includes a relatively larger volumetric size for selectively receiving and retaining the entire beverage 18 from the bottle 14 in a single pour. Persons of ordinary skill in the art will readily recognize that the beverage 18 for use with the glass 12 and/or the bottle 14 as described herein may be many different types of beverages known in the art such as wine, beer, water, milk, tea, coffee, carbonated drinks, juice and juice drinks, cider, spirits, etc.

Figure 5:
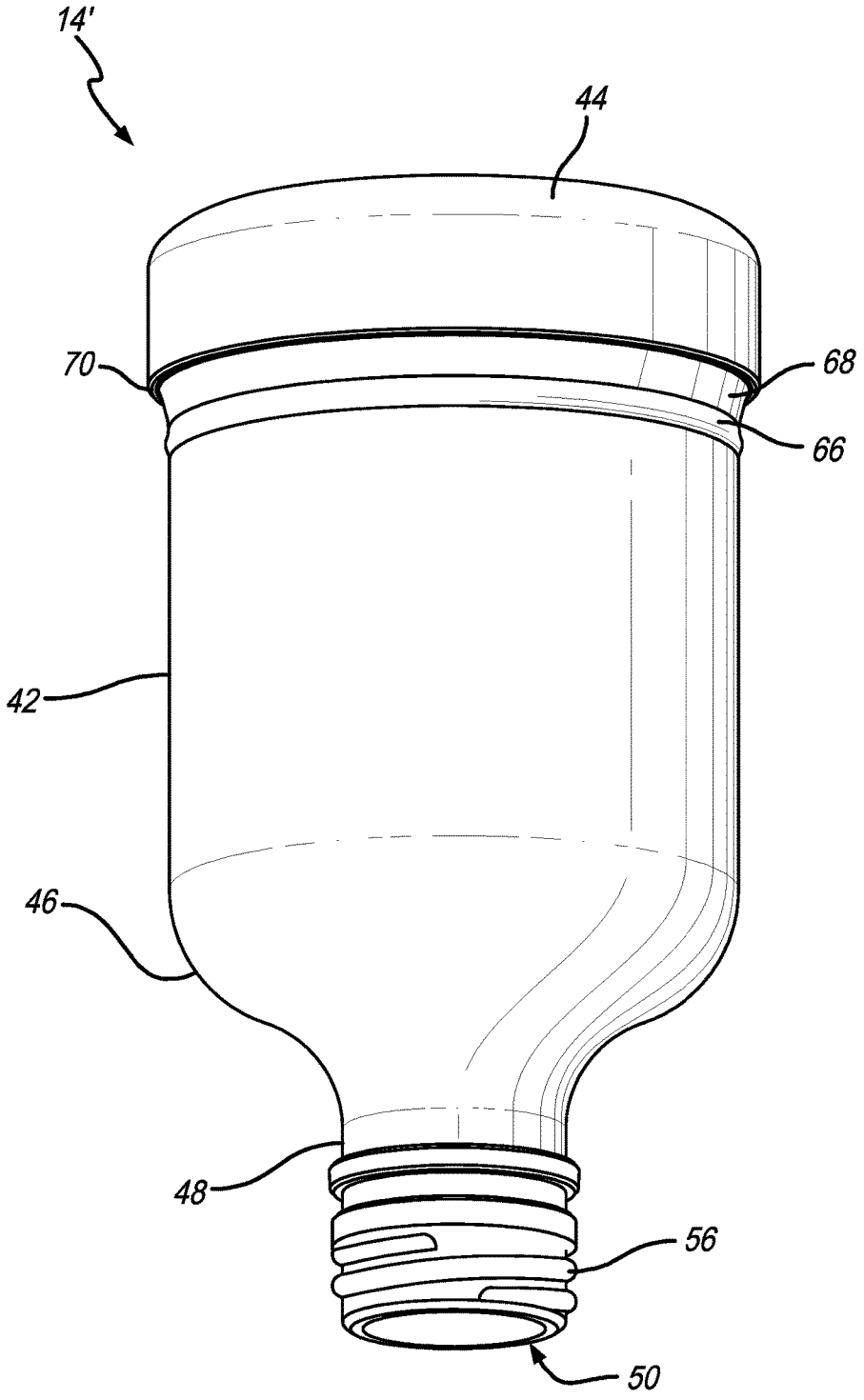
FIG. 5 is perspective view illustrating another embodiment of an inverted bottle having a circumferential external detent formed along an exterior cylindrical bottle body and configured to selectively engage an upper lip of the glass.

In another embodiment of the combination package 10 disclosed herein, FIG. 5 illustrates an alternative bottle 14' shown in an inverted position without the cap 52 installed. In this embodiment, the external threads 56, the spout 50, the neck 48, and the shoulder 46 are similar to those features described above with respect to FIGS. 2-4. Although, in this embodiment, the bottle 14' includes a pronounced circumferential external detent 66 extending around the circumference of the otherwise consistent diameter body 42 near the lower base 44 as shown in FIG. 5. The circumferential external detent 66 may protrude approximately 0.015 to 0.045 inches out from the outer diameter of the body 42. Furthermore, the bottle 14' may include a slant 68 having an initial diameter approximately the diameter of the body 42 and less than the outer diameter of the outwardly protruding circumferential external detent 66. The slant 68 extends upwardly and outwardly (e.g., at an angle between 10 and 18 degrees) from the body 42, generally increasing in diameter before terminating at a position adjacent the lower base 44. Here, the slant 68 transitions to the lower base 44 by way of a ledge or step 70 at approximately a 90 degree angle, the lower base 44 being larger in diameter relative to the widest part of the slant 68. The combination of the circumferential external detent 66 and the slant 68 aids in a friction or interference fit between the bottle 14' and the glass upper lip 26, as discussed herein.

Figure 6:
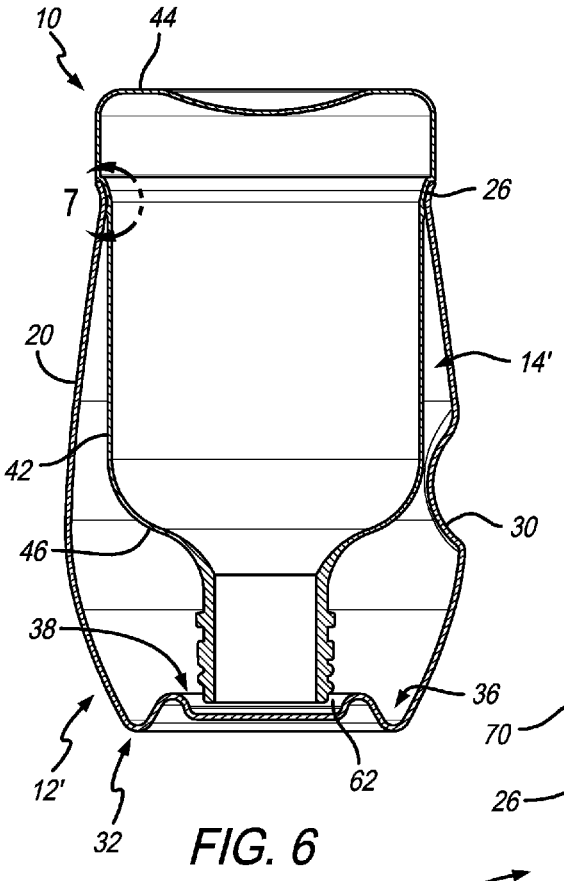
FIG. 6 is a vertical sectional view of the inverted bottle of FIG. 5 inserted within another embodiment of a glass as disclosed herein.
Figure 7:
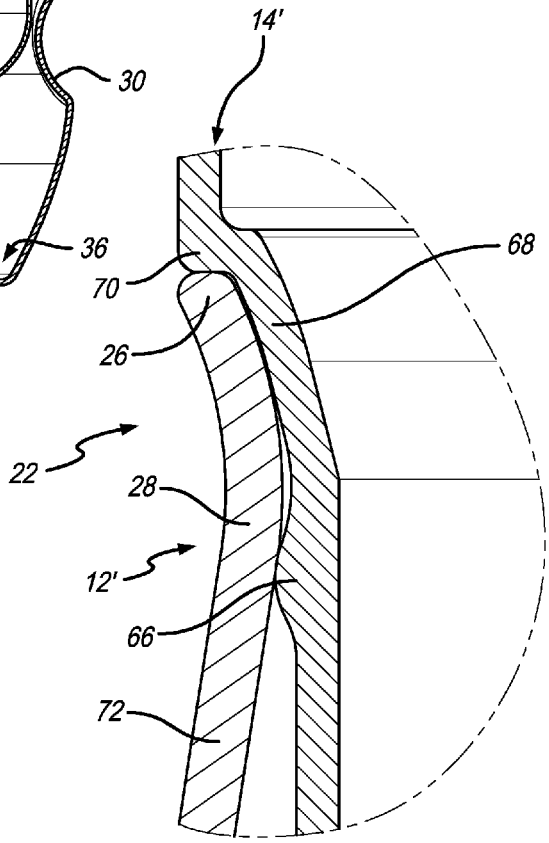
FIG. 7 is an enlarged vertical sectional view taken about the circle 7 in FIG. 6, further illustrating a friction or interference fit between the upper lip of the glass of FIG. 6 and the circumferential external detent and corresponding slanted section of the bottle of FIG. 5.

For example, FIG. 6 is a vertical sectional view more specifically illustrating the bottle 14' of FIG. 5 inserted in an inverted orientation within an alternative embodiment of a glass 12'. Here, the bottle 14' remains attached within the glass 12' by substantial friction or interference fit. For instance, FIG. 7 is an enlarged vertical sectional view illustrating the upper rim 22 of the glass 12' lodged up over the circumferential external detent 66, within a portion of the slant 68 and up underneath the step 70. The rim 22 of the glass 12' transitions from a generally inwardly tapering section 72 of the upper body 20 to a generally outwardly projecting arced upper lip 26 that forms the indent 28 therebetween, as described above. As shown in FIG. 7, the inwardly tapering section 72 has an internal diameter approximately equal to or preferably somewhat smaller than the outside diameter of the outwardly projecting circumferential external detent 66 for friction or interference fit therewith. Furthermore, the angle of the outwardly projecting slant 68 is shown being somewhat greater than the arc forming the indent 28 and terminating in the upper lip 26. In this respect, the upper rim 22 of the glass 12' twice contacts the bottle 14', once along the circumferential external detent 66 at the inwardly tapering section 72 and a second time against a larger surface area along the slant 68 before flaring back out to the upper lip 26. The difference in radial extension from the center-axis of the indent 28 to the outside edge of the arched upper lip 26 may be approximately 0.015-0.055 inches and the vertical distance between the center of curvature of the indent 28 and the edge of the upper lip 26 may be approximately 0.080-0.240 inches. The step 70 provides a stop to terminate slide-on engagement of the glass 12' at the desired depth, such as that shown in FIG. 6, wherein the cap 52 terminates just above the central component 38. Alternatively, the inwardly tapering section 72 may not flare out to create the indent 28 or the outwardly arcing upper rim 22. Here, the upper rim 22 may simply project over the circumferential external detent 66 and into the slant 68.

Additionally, FIGS. 6 and 7 illustrate that the glass 12' and the bottle 14' may be assembled as a single package 10, without the addition of the external seal 16. Here, the friction or interference fit between the upper rim 22 of the glass 12' and the circumferential external detent 66 and the slant 68 of the bottle 14' provide adequate non-slip engagement. Although, the external seal 16 could be used in connection with this embodiment as well, as described herein. Moreover, while the lower base 32 is shown including the aforementioned punt 34 and the corresponding moat 36, the glass 12' may also be formed without the punt 34 and/or the moat 36.

Figure 8:
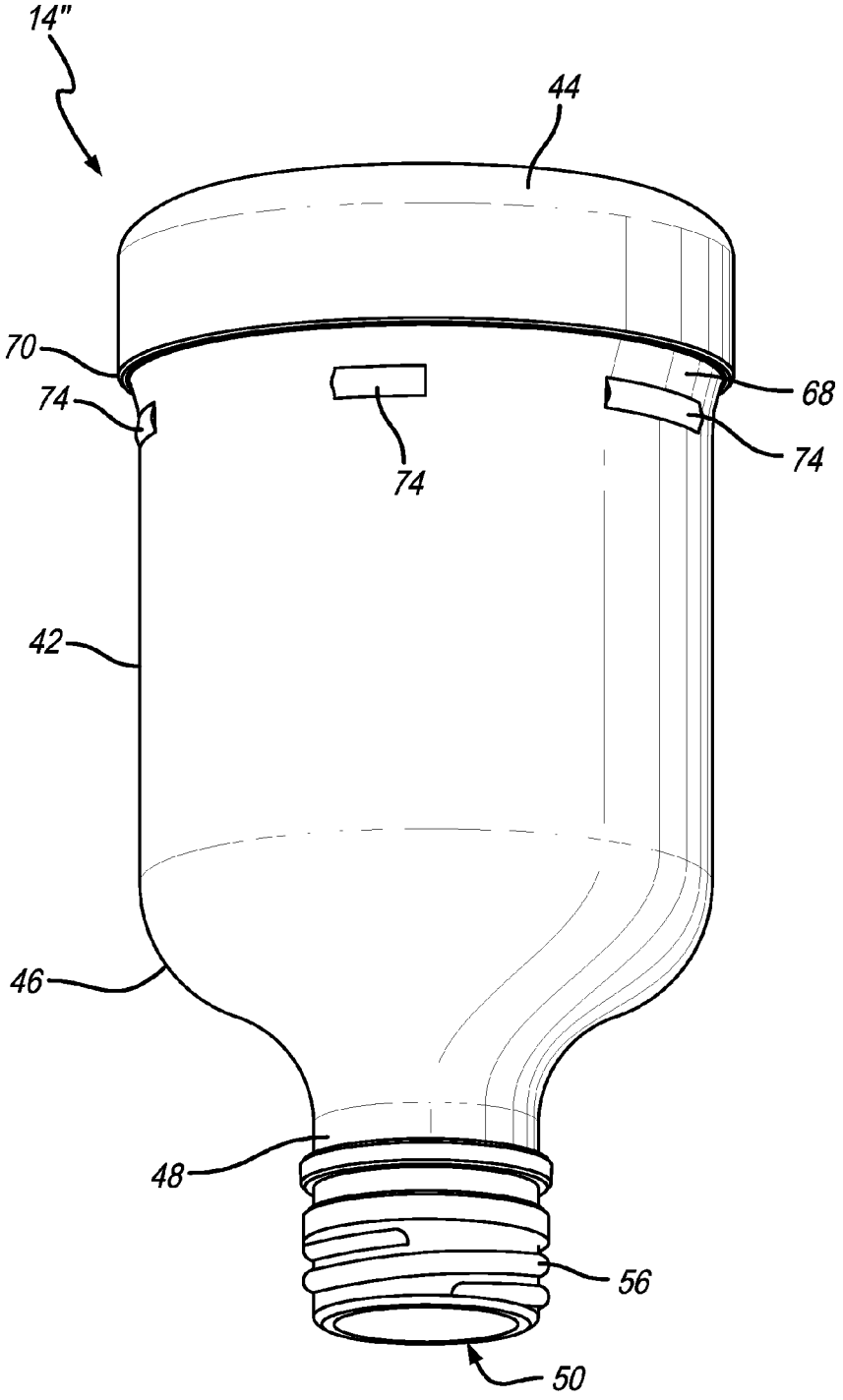
FIG. 8 is a perspective view illustrating another embodiment of an inverted bottle having a plurality of outwardly projecting detent sections circumferentially disposed around the external surface of the bottle body.

In another embodiment of the combination package 10 disclosed herein, FIG. 8 illustrates an alternative bottle 14" shown in an inverted position and without the cap 52 installed. Similarly, in this embodiment, the external threads 56, the spout 50, the neck 48, and the shoulder 46 are similar to those features described above with respect to FIGS. 2-6 above. Although, in this embodiment, the pronounced circumferential external detent 66 extending around the circumference of the otherwise consistent diameter body 42 near the lower base 44 is broken into a series of detent sections 74 which may be equally spaced as shown in FIG. 8 in a plane perpendicular to the central axis of the lower base 44. The external detent sections 74 may similarly protrude approximately 0.015 to 0.045 inches out from the outer diameter of the body 42 and permit the escape of air out from within the interior of the glass 12' when the bottle 14" is inserted therein, such as into the position shown in FIG. 9. Similarly, the slant 68 includes an initial diameter approximately equal to the diameter of the body 42, e.g., shown in FIG. 8 as a smooth transitional surface between the body 42 and the slant 68 between the detent sections 74, and less than the outer diameter of the outwardly protruding external detent sections 74. The slant 68 extends upwardly and outwardly from the body 42 generally increasing in diameter (e.g., at an angle between 10 and 18 degrees) before terminating at a position adjacent the lower base 44. Here, the slant 68 similarly transitions to the lower base 44 by way of the ledge or step 70 at approximately 90 degree angle, the lower base 44 being larger in diameter relative to the widest part of the slant 68. The combination of the plurality of detent sections 74 disposed intermittently around the outer circumference of the upper body 20 and the slant 68 aids in a friction or interference fit between the bottle 14" and the upper rim 22 of the glass 12', as discussed herein.

Figure 9:
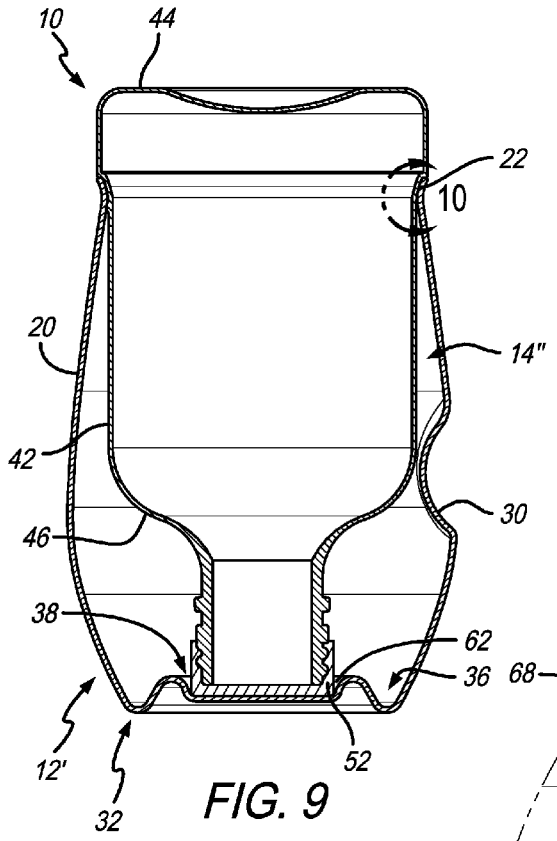
FIG. 9 is a vertical sectional view of the inverted bottle of FIG. 8 inserted within a glass as disclosed here.
Figure 10:
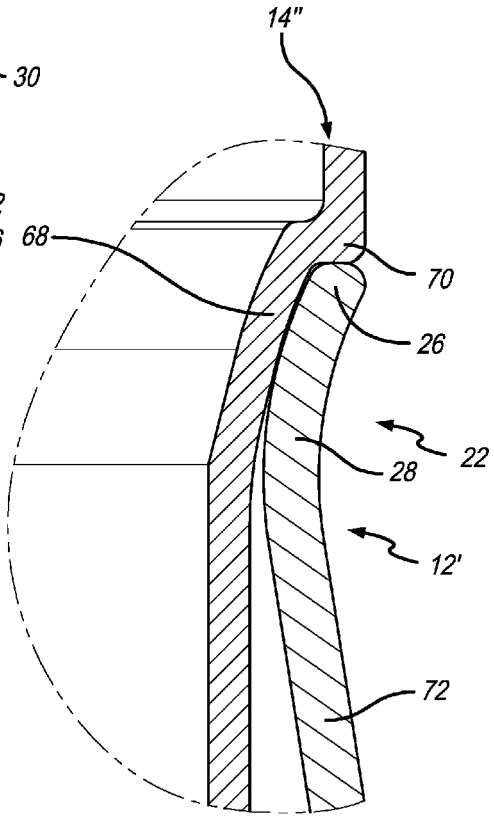
FIG. 10 is an enlarged vertical sectional view taken about the circle 10 in FIG. 9, further illustrating a friction or interference fit between the glass upper lip and the bottle slanted section, between the detent sections.

For example, FIG. 9 is a vertical sectional view more specifically illustrating the bottle 14" of FIG. 8 inserted in an inverted orientation within the glass 12', for retention therein by substantial friction or interference fit. For instance, in one aspect, the glass 12' lodges up over each of the external detent sections 74, within a portion of the slant 68, and up underneath the step 70, as described above with respect to the circumferential external detent 66 (e.g., FIG. 7). Additionally, FIG. 10 illustrates an enlarged vertical sectional view of the upper lip 26 of the glass 12' positioned generally flush against the surface of the slant 68. FIG. 10 is illustrative of areas of the bottle 14" between the external detent sections 74. In the embodiment illustrated in FIG. 10, the glass 12' similarly transitions from a generally inwardly tapering section 72 of the upper body 20 to a generally outwardly projecting arced upper lip 26 that forms the indent 28 therebetween. The inwardly tapering section 72 may include an internal diameter approximately equal and preferably somewhat smaller than the outwardly projecting detent sections 74 for friction or interference therewith, similar to the friction or interference fit with the circumferential external detent 66. Furthermore, the angle of the outwardly projecting slant 68 is shown being somewhat greater than the arc forming the indent 28. In this respect, similar to FIG. 7, the upper wall of the glass 12' twice contacts the bottle 14', once at each of the detent sections 74 and again along a larger surface area of the slant 68, before flaring back out to the upper lip 26. The difference in radial extension from the center-axis of the indent 28 to the outside edge of the arched upper lip 26 and the vertical distance between the center of curvature of the indent 28 and the edge of the upper lip 26 may be similar to that disclosed above with respect to FIGS. 7-9. Of course, the upper lip 26 may be formed at an angle similar to that of the slant 68 to maximize surface area engagement therebetween. The step 70 provides a stop to terminate slide-on engagement of the glass 12' at the desired depth, such as that shown in FIG. 9 wherein the cap 52 terminates just above the central component 38.

Additionally, FIGS. 9 and 10 illustrate that the glass 12' and the bottle 14" may be assembled as a single package 10, without the addition of the external seal 16. Here, the friction or interference fit between the upper body 20 of the glass 12' and the detent sections 74 and the slant 68 of the bottle 14" again provide adequate non-slip engagement. Although, the external seal 16 could be used in connection with this embodiment as well, as described herein. Moreover, while the lower base 32 is shown including the aforementioned punt 34 and the corresponding moat 36, the glass 12' may also be formed without the punt 34 and/or the moat 36.

In another alternative embodiment, the bottle 14" may be formed without any of the plurality of detent sections 74 such that the upper rim 22 of the glass 12' engages only the slant 68 around the circumference of the bottle 14" for friction or interference fit therewith, such as shown in FIG. 10.

Figure 11:
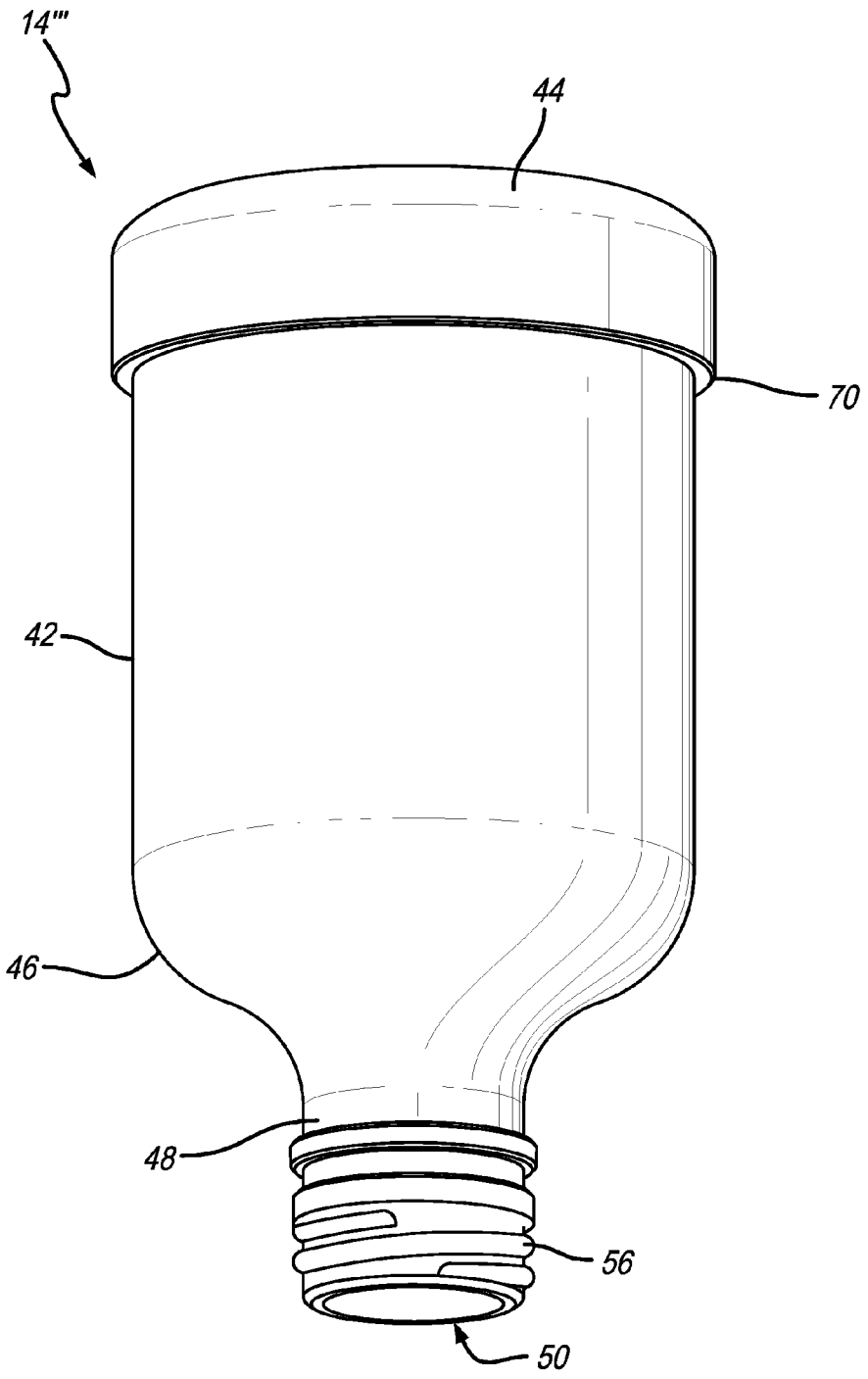
FIG. 11 is a perspective view of another alternative embodiment of an inverted bottle, illustrating a relatively constant diameter cylindrical body transitioning to a stepped base.
Figure 13:
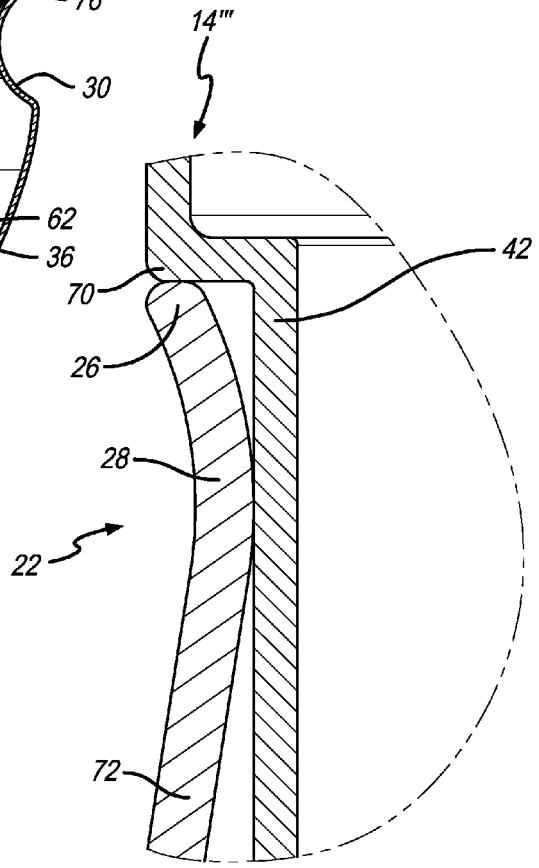
FIG. 13 is an enlarged vertical sectional view taken about the circle 13 in FIG. 12, further illustrating a friction or interference fit between the glass upper lip and the outer body sidewall of the bottle of FIG. 11.

In another embodiment of the combination package 10 disclosed herein, FIG. 11 illustrates an alternative bottle 14''' shown in an inverted position without the cap 52 installed. Similarly, in this embodiment, the external threads 56, the spout 50, the neck 48, and the shoulder 46 are similar to those features described above with respect to FIGS. 2-6, and 8-9 above. Here, the body 42 is shown having a generally consistent outer diameter that spans the distance between the shoulder 46 and the lower base 44, the lower base 44 having an outer diameter relatively larger than the outer diameter of the body 42. In this respect, the body 42 transitions to the lower base 44 by way of the ledge or step 70 at approximately a 90 degree angle, as shown in more detail in FIG. 13. In this respect, FIG. 12 is a vertical sectional view more specifically illustrating the bottle 14''' of FIG. 11 inserted in an inverted orientation within the glass 12', for retention therein by substantial friction or interference fit. FIG. 13 more specifically illustrates the upper rim 22 of the glass 12', and more specifically the indent 28, positioned against the body 42 of the bottle 14'''. The upper rim 22 transitions from the generally inwardly tapering section 72 of the upper body 20 to a generally outwardly projecting arced upper lip 26 that forms the indent 28 therebetween, as described above. The outside radius of the indent 28 is of a smaller diameter relative to the outside diameter of the body 42, to facilitate the friction or interference fit disclosed herein. Alternatively, instead of the inwardly tapering section 72 transitioning into an outwardly flaring upper lip 26, thereby creating the indent 28, the inwardly tapering section 72 may simply transition into a vertical upper lip 26 that more closely tracks the outside diameter of the body 42 along its length, thereby increasing the surface area interference with the bottle 14''' and the friction fit engagement between the glass 12' and the bottle 14'''. Of course, the glass 12' and the bottle 14''' illustrated in FIGS. 11-13 may similarly be assembled as a single package 10 (FIG. 12), without the addition of the external seal 16. Here, the friction or interference fit between the upper lip 22 of the glass 12' and the body 42 of the bottle 14" provides adequate non-slip engagement. Although, the external seal 16 could be used in connection with this embodiment as well, as described herein. Additionally, while the lower base 32 is shown including the aforementioned punt 34 and the corresponding moat 36, the glass 12' may also be formed without the punt 34 and/or the moat 36.

Also, as shown in FIG. 12, the glass 12' and the bottle 14''' may be of a size and shape to permit select engagement of the body 42 or the shoulder 46 of the bottle 14''' with the inwardly projecting notched indent 30, such as at reinforcement point 76. Biasing the bottle 14''' against the notched indent 30 may help stabilize side-to-side movement of the bottle 14''' within the interior of the glass 12' during transport or otherwise. Similarly, structuring the glass 12' and the bottle 14''' such that the cap 52 sits flush against the central component 38 provides a second vertical contact point that may further facilitate stability of the bottle 14''' within the interior of the glass 12' during transportation or otherwise. Here, the central component 38 may also be flexible to permit the bottle 14''' to be wedged between the central component 38 and the step 70.

Figure 14:
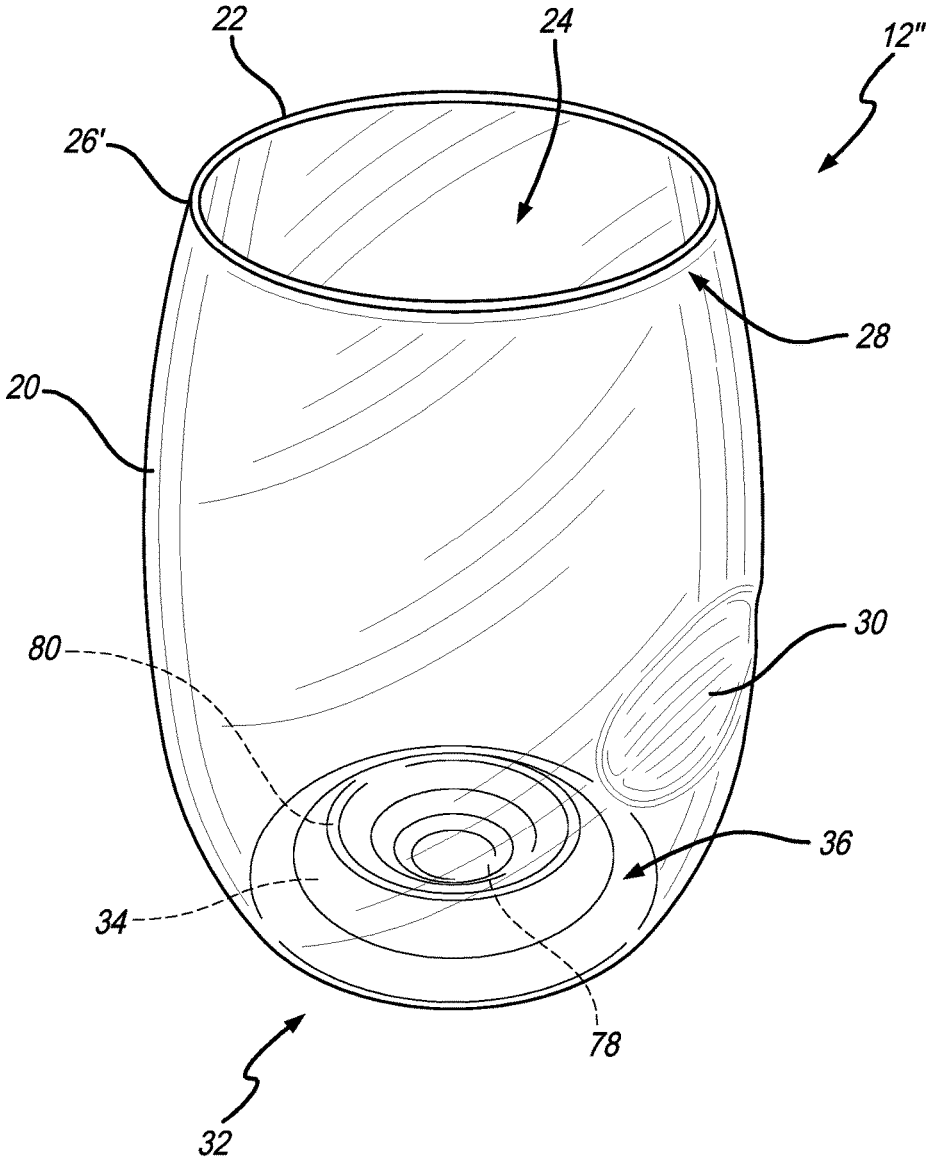
FIG. 14 is a perspective view illustrating one embodiment of an alternative glass for use as part of a combination glass and bottle as disclosed herein.

FIG. 14 illustrates another alternative of a glass 12" that may be used with one or more of the bottles 14, 14', 14", 14''' to form the combination package 10 as disclosed herein. More specifically the glass 12" may similarly be constructed from a unitary molded plastic material such as by way of extrusion molding, blow molding, or the like, such as PET plastic or BPA-free plastic, including being constructed from other materials such as glass, metal, etc. In one embodiment, the glass 12" may have a unitary or one-piece construction adapted to receive and support one of the bottles 14, 14', 14", 14''' in an inverted orientation substantially within the glass 12". In this respect, FIG. 15 illustrates one such embodiment where the package 10 includes the glass 12" and the bottle 14''' assembled and maintained in a single unitized commercial unit.

More specifically with respect to the glass 12" illustrated FIG. 14, the glass 12" includes the upper flume or body 20 having the upwardly narrowing or upwardly converging cross sectional size. Furthermore, the glass 12" may have a generally uniform thickness and smooth contoured geometry that may be used to concentrate wine aroma or bouquet near the top. The upper body 20 terminates in the upper rim 22 defining the generally circular open mouth 24 sized to selectively receive one of the bottles 14, 14', 14", or 14''' therein. The rim 22 in this embodiment does not include the aforementioned arced configuration. Instead, the rim 22 simply terminates in a straight upper lip 26' having a diameter relatively smaller than the widest diameter of the upper body 20, as shown more specifically with respect to the cross-sectional views of FIGS. 15 and 16. Similar to the glasses 12, 12' mentioned above, the glass 12" may also include the notched indent 30 (e.g., non-circumferential or circumferential) formed in the upper body 20. Of course, the notched indent 30 could be formed in at least one side of the upper body 20 as shown, multiple sides of the upper body 20, or even circumferentially, including at the generally centered vertical location as shown in FIGS. 14 and 15. The upper body 20 generally tapers inwardly toward the lower base 32 opposite the upper rim 22. The lower base 32 may similarly include a contour that defines the upstanding punt 34 surrounded by the recessed annular moat 36 circumscribing a concave bowl or cup 78.

The glass 12" may also include the alternative configurations mentioned above, such as, e.g., a filled lower base 32 whereby the volume under the punt 34 and the bowl or cup 78 are filled in with material (e.g., plastic) to make the glass 12" more bottom heavy for purposes of lowering the center of gravity. Additionally, the lower base 32 may not include the upstanding punt 34 and/or the bowl or cup 78. In this embodiment, the lower base 32 may be flat.

Figure 15:
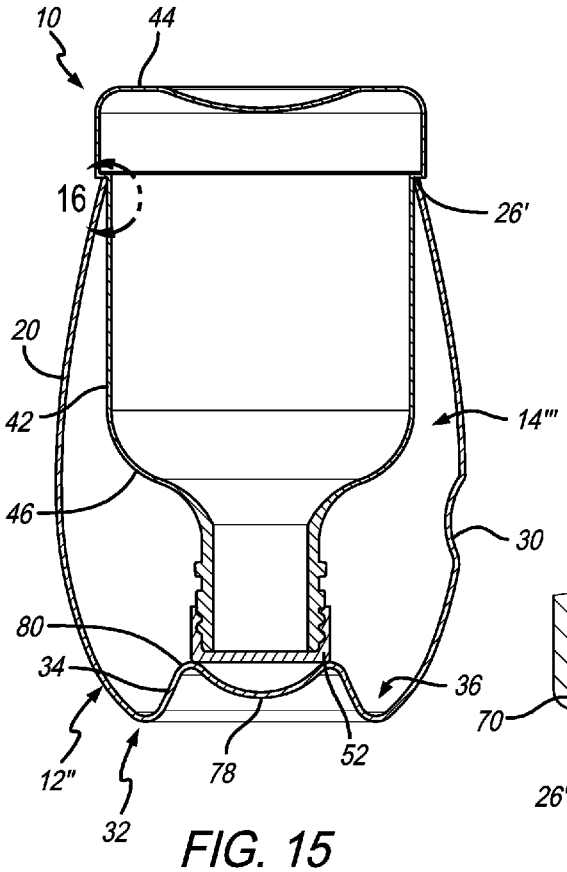
FIG. 15 is a vertical sectional view of the inverted bottle of FIG. 11 inserted within the glass of FIG. 14.
Figure 16:
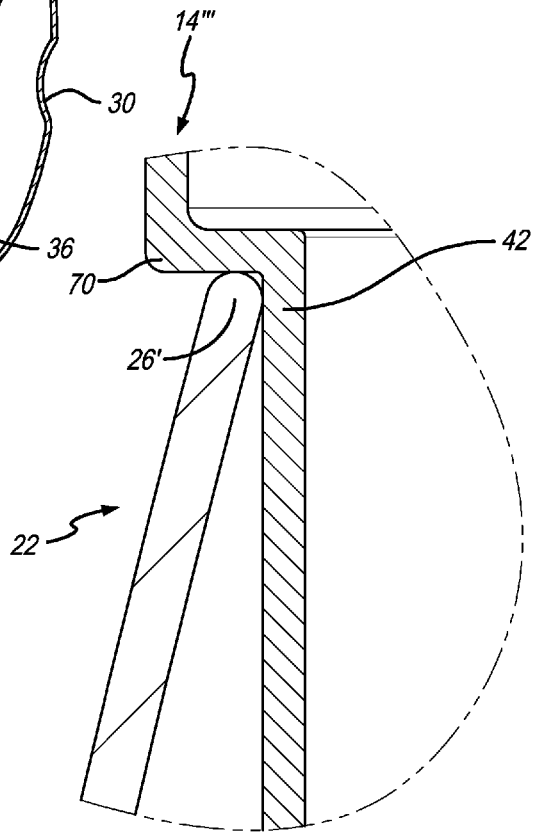
FIG. 16 is an enlarged vertical sectional view taken about the circle 16 in FIG. 15, further illustrating a friction or interference fit between the upper lip of the glass of FIG. 14 and the outer body sidewall of the bottle of FIG. 11.

FIG. 15 illustrates a vertical sectional view of the bottle 14''' of FIG. 11 inserted in an inverted orientation within the glass 12" of FIG. 14, for retention therein by substantial friction or interference fit. FIG. 16 more specifically illustrates the upper rim 22 of the glass 12", and more specifically the straight upper lip 26', positioned against the body 42 of the bottle 14'''. In one embodiment, the straight upper lip 26' may have an inner diameter somewhat smaller than the outer diameter of the body 42 to facilitate said friction or interference fit between the glass 12" and the bottle 14'''. In this respect, the bottle 14''' may slide into the open mouth 24 of the glass 12" wherein the upper lip 26' substantially tracks the outer diameter sidewall of the body 42 along its length until completely seated therein. As shown in FIG. 15, in this embodiment, the cap 52 may terminate against and rest on an upper rim 80 of the punt 34 simultaneously while the straight upper lip 26' is tucked into the transition between the body 42 and the outwardly projecting step 70, as shown in FIG. 16.

Of course, the glass 12" and the bottle 14''' illustrated in FIGS. 14-16 may similarly be assembled as a single package 10 (FIG. 15), without the addition of the external seal 16. Here, the friction or interference fit between the straight upper lip 26' of the glass 12" and the body 42 of the bottle 14''' provides adequate non-slip engagement, while still allowing for removal of the glass bottle 14''' from the glass 12". Although, the external seal 16 could be used in connection with this embodiment as well, as described herein. Additionally, while the lower base 32 is shown including the aforementioned punt 34 and the corresponding moat 36, the glass 12" may also be formed without the punt 34 and/or the moat 36.

Figure 17:
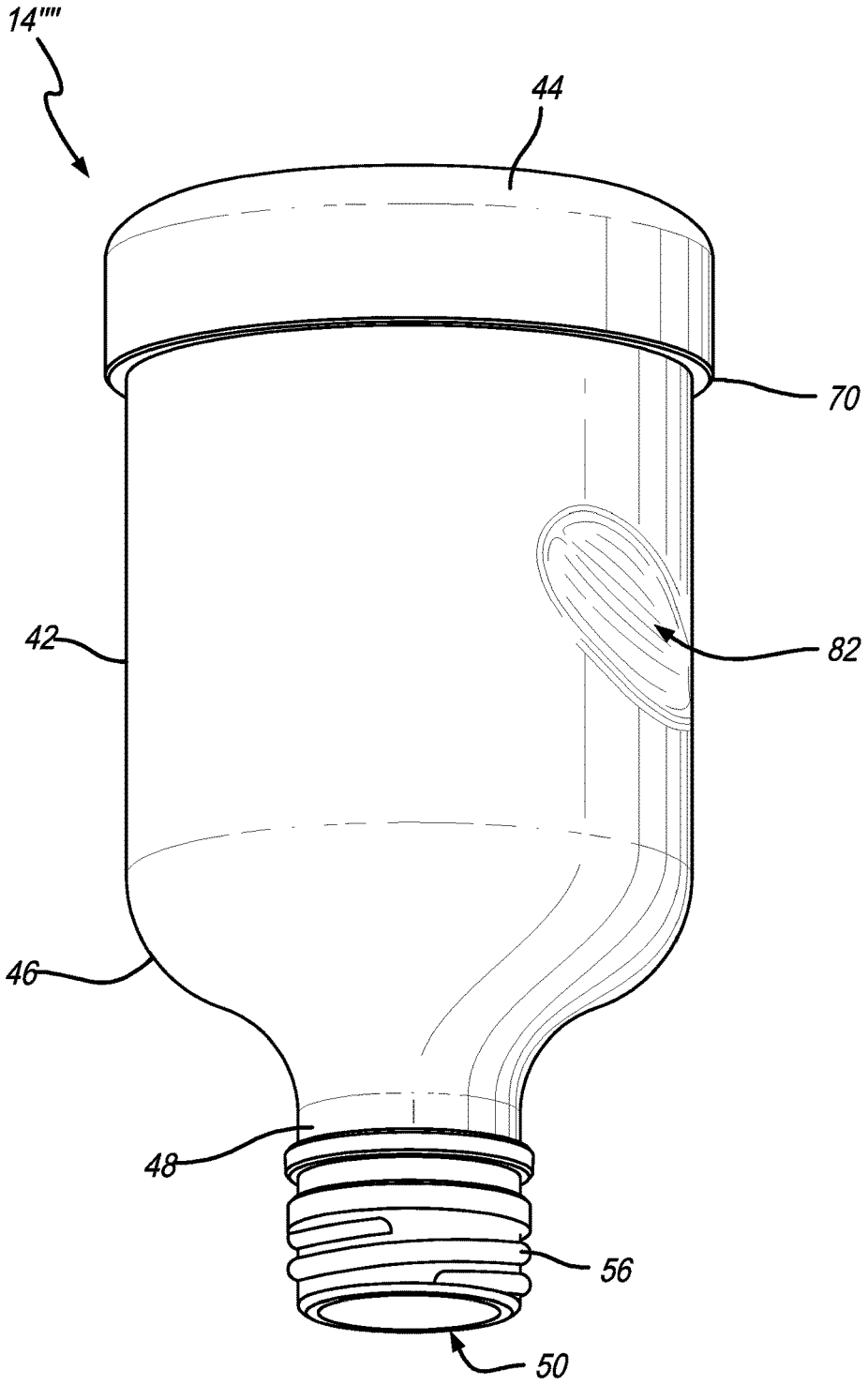
FIG. 17 is a perspective view of an alternative inverted bottle having an external bottle notch therein.
Figure 18:
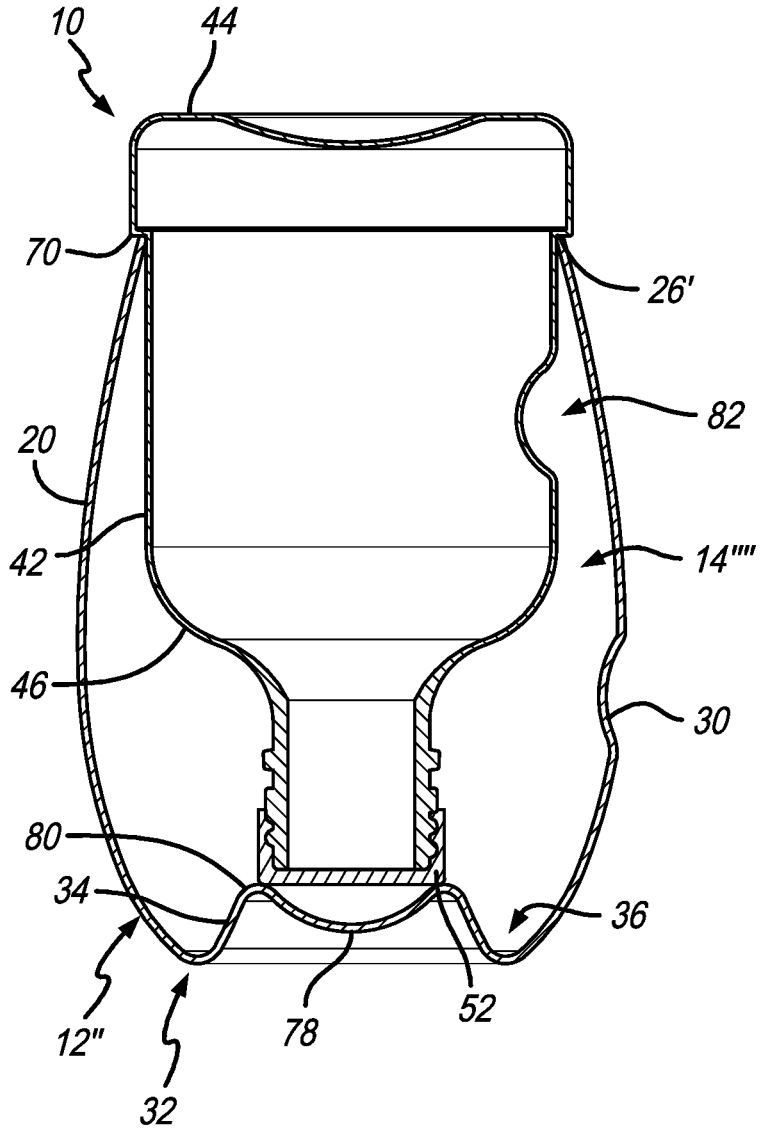
FIG. 18 is a vertical sectional view similar to FIG. 15, further illustrating the alternative inverted bottle with the external bottle notch of FIG. 17 inserted within the glass of FIG. 14.

FIG. 17 illustrates another alternative embodiment of a bottle 14'''' in an inverted position and without the cap 52 installed thereon. This embodiment is similar to the bottle 14''' described above with respect to FIGS. 2-6, 8-9, and 11-13, namely the bottle 14'''' includes the external threads 56 for engagement with the cap 52, the spout 50, the neck 48, and the shoulder 46. As shown in FIG. 17, the bottle 14'''' also includes the body 42 generally spans the distance between the shoulder 46 and the lower base 44, the lower base 44 having an outer diameter relatively larger than the outer diameter of the body 42, thereby forming a transitional ledge or step 70 therebetween at approximately a 90 degree angle. Additionally, the bottle 14'''' also includes a bottle notch 82 formed into a portion of the sidewall of the body 42 and extends inwardly therefrom as shown in FIGS. 17 and 18. In one embodiment, the bottle notch 82 may be a generally elliptical concave shape having a smooth or relatively consistent outwardly presented surface.

FIG. 18 is a vertical sectional view more specifically illustrating the bottle 14'''' of FIG. 17 inserted in an inverted orientation within the glass 12", for retention therein by substantial friction or interference fit. FIG. 18 more specifically illustrates the upper lip 26' of the glass 12" positioned against the body 42 of the bottle 14" and up underneath the step 70, as described above with respect to the glass 12'''' and the bottle 14''' in FIGS. 14-16. Further in this respect, the upper lip 26' may have an inner diameter somewhat smaller than the outer diameter of the body 42 to facilitate said friction or interference fit between the glass 12" and the bottle 14''''. In this respect, the bottle 14''' may slide into the open mouth 24 of the glass 12" wherein the upper lip 26' substantially tracks the outer diameter sidewall of the body 42 along its length until completely seated therein underneath the step 70. The cap 52 may terminate against and rest on the upper rim 80 of the punt 34 simultaneously while the straight upper lip 26' is tucked into the transition between the body 42 and the outwardly projecting step 70. The concave inwardly projecting structure of the bottle notch 82 is also illustrated in FIG. 18 as a cross-section thereof. As shown, the bottle notch 82 has a relatively consistent wall thickness being approximately the same thickness as the wall of the body 42.

Of course, the glass 12" and the bottle 14"" illustrated in FIG. 18 may similarly be assembled as a single package 10, without the addition of the external seal 16. Here, the friction or interference fit between the upper lip 26' of the glass 12" and the body 42 of the bottle 14"" provides adequate non-slip engagement. Although, the external seal 16 could be used in connection with this embodiment as well, as described herein.

While the foregoing description and accompanying drawings show the bottles 14-14'" inverted for reception into the glasses 12-12", persons skilled in the art will recognize that an inverse construction is also contemplated, namely, that the glasses 12-12" may be inverted over the upright bottles 14-14'". Additionally, the features of each of the bottles 14-14'", as described above, may be mixed and/or matched in different combinations with the features described above with respect to each of the glasses 12-12".

Although several embodiments have been described in detail for purposes of illustration, various modifications may be made without departing from the scope and spirit of the invention. Accordingly, the invention is not to be limited, except as by the appended claims.

What is claimed is:

1. A combination package, comprising:

a beverage glass having an upper shell-shaped body defining an upwardly narrowing tapered flume of generally uniform thickness terminating in a smooth upper rim including a radially outwardly extending upper lip thereof defining an open mouth, and a lower base opposite the open mouth; and a bottle defining a container for retaining a beverage and a pour spout for dispensing the beverage therefrom, the bottle having a size and shape for select slide-in reception through the open mouth of the beverage glass in an inverted orientation such that the upwardly narrowing tapered flume selectively engages a sidewall of the container for friction-fit engagement therewith, wherein engagement of the bottle with the beverage glass forms the combination package.

2. The combination of claim 1, wherein the bottle includes a detent protrusion at least partially disposed around the circumference of the bottle.

3. The combination of claim 2, wherein the detent protrusion comprises a continuous circumferential external detent or a plurality of outwardly presented discrete detent sections.

4. The combination of claim 2, wherein the bottle includes a slant adjacent to and increasing in diameter away from the detent protrusion and toward a bottom of the bottle.

5. The combination of claim 4, wherein the bottom includes an outer diameter relatively larger than the open mouth, thereby closing the open mouth when the bottle is seated within the beverage glass.

6. The combination of claim 4, wherein the slant includes an angle between 10 and 20 degrees.

7. The combination of claim 4, wherein when the bottle is engaged with the beverage glass, the smooth upper rim of the beverage glass twice contacts the bottle, a first contact comprising over the detent protrusion and a second contact comprising against the slant.

8. The combination of claim 1, wherein the bottle includes a step that selectively engages the smooth upper rim to terminate slide-in engagement of the bottle into the beverage glass.

9. The combination of claim 1, wherein the smooth upper rim comprises the radially outwardly extending upper lip disposed above an relatively shallow indent formed above the inwardly narrowing tapered flume.

10. The combination of claim 9, including a seal member comprising a shrink-wrap film wrapped around the beverage glass and the bottle and at least partially disposed within the relatively shallow indent, the seal member being selectively removable to permit access to and removal of the bottle from the beverage glass.

11. The combination of claim 1, wherein the upper shell-shaped body tapers into the lower base having a diameter relatively smaller than the largest outside diameter of the upper shell-shaped body.

12. The combination of claim 1, wherein the lower base includes an upstanding punt surrounded by a recessed annular moat circumscribing a relatively flat central component having a smooth inner surface.

13. The combination of claim 12, wherein the bottle includes a cap selectively engaged to and closing the pour spout, the cap having a relatively flat-topped configuration for flush seating within the flat central component.

14. The combination of claim 1, wherein the beverage glass volume is relatively larger than the bottle volume.

15. The combination of claim 1, wherein the beverage glass includes a non-circumferential notched indent defining an upwardly-presented exterior shelf.

16. The combination of claim 15, wherein the non-circumferential notched indent inwardly projects into the beverage glass and contacts a portion of the bottle when the bottle is seated within the beverage glass.

17. The combination of claim 1, wherein the beverage glass comprises a truncated spheroid.

18. The combination of claim 1, wherein the bottle outer wall includes a slant increasing in diameter toward a bottom of the bottle.

19. The combination of claim 1, wherein the bottle includes a notch.

20. A combination package, comprising:

a beverage glass having an upper shell-shaped body defining an upwardly narrowing tapered flume of generally uniform thickness terminating in a smooth upper rim including a radially outwardly extending upper lip thereof defining an open mouth, and a lower base opposite the open mouth; and a bottle defining a container for retaining a beverage, a pour spout for dispensing the beverage therefrom, and a detent protrusion at least partially disposed around the circumference of the bottle, the bottle having a size and shape for select slide-in reception through the open mouth of the beverage glass in an inverted orientation only so far as the smooth upper rim contacts an outwardly protruding step terminating slide-in engagement of the bottle into the beverage glass, wherein when the bottle is engaged with the beverage glass thereby forming the combination package, the smooth upper rim at least partially engages the detent protrusion for friction-fit engagement therewith and a relatively larger diameter bottom closes the open mouth when the bottle is seated within the beverage glass.

21. The combination of claim 20, wherein the detent protrusion comprises a continuous circumferential external detent or a plurality of outwardly presented discrete detent sections and the bottle includes a slant adjacent to and increasing in diameter away from the detent protrusion and toward the bottom of the bottle.

22. The combination of claim 21, wherein the slant includes an angle between 10 and 20 degrees and, when the bottle is engaged with the beverage glass, the smooth upper rim of the beverage glass twice contacts the bottle, a first contact comprising over the detent protrusion and a second contact comprising against the slant.

23. The combination of claim 20, wherein the smooth upper rim comprises the radially outwardly extending upper lip disposed above an relatively shallow indent formed above the inwardly narrowing tapered flume and the upper shell-shaped body tapers into the lower base having a diameter relatively smaller than the largest outside diameter of the upper shell-shaped body.

24. The combination of claim 23, including a seal member comprising a shrink-wrap film wrapped around the beverage glass and the bottle and at least partially disposed within the relatively shallow indent, the seal member being selectively removable to permit access to and removal of the bottle from the beverage glass.

25. The combination of claim 20, wherein the beverage glass volume is relatively larger than the bottle volume, the beverage glass includes a non-circumferential notched indent defining an upwardly-presented exterior shelf, the beverage glass comprises a truncated spheroid, and wherein the lower base includes an upstanding punt surrounded by a recessed annular moat circumscribing a relatively flat central component having a smooth inner surface.

26. The combination of claim 25, wherein the bottle includes a cap selectively engaged to and closing the pour spout, the cap having a relatively flat-topped configuration for flush seating within the flat central component and the non-circumferential notched indent inwardly projects into the beverage glass and contacts a portion of the bottle when the bottle is seated within the beverage glass.

27. The combination of claim 20, wherein the bottle includes a generally elliptically shaped notch including a relatively smooth and outwardly presented concave surface.

28. A combination package, comprising:

a beverage glass having an upper shell-shaped body defining an upwardly narrowing tapered flume of generally uniform thickness that terminates at one end in a smooth upper rim defining an open mouth and tapers at another end into a lower base having a diameter relatively smaller than the largest outside diameter of the upper shell-shaped body, wherein the smooth upper rim includes a radially outwardly extending upper lip disposed above an relatively shallow indent formed above the inwardly narrowing tapered flume; and a bottle defining a container for retaining a beverage and including a slant increasing in diameter toward a bottom of the bottle, and a pour spout for dispensing the beverage therefrom, the bottle having a size and shape for select slide-in reception through the open mouth of the beverage glass in an inverted orientation such that the upwardly narrowing tapered flume selectively engages a sidewall of the container for friction-fit engagement, wherein engagement of the bottle with the beverage glass forms the combination package.

29. The combination of claim 28, wherein the bottle includes a detent protrusion at least partially disposed around the circumference of the bottle and the slant is adjacent to and increases in diameter away from the detent protrusion and toward a bottom of the bottle, which includes an outer diameter relatively larger than the open mouth, thereby closing the open mouth when the bottle is seated within the beverage glass.

30. The combination of claim 29, wherein the detent protrusion comprises a continuous circumferential external detent or a plurality of outwardly presented discrete detent sections and the slant includes an angle between 10 and 20 degrees, wherein when the bottle is engaged with the beverage glass, the smooth upper rim of the beverage glass twice contacts the bottle, a first contact comprising over the detent protrusion and a second contact comprising against the slant.

31. The combination of claim 28, including a seal member comprising a shrink-wrap film wrapped around the beverage glass and the bottle and at least partially disposed within the relatively shallow indent, the seal member being selectively removable to permit access to and removal of the bottle from the beverage glass, wherein the beverage glass further includes a non-circumferential notched indent defining an upwardly-presented exterior shelf.

32. The combination of claim 31, wherein the beverage glass volume is relatively larger than the bottle volume and the non-circumferential notched indent inwardly projects into the beverage glass and contacts a portion of the bottle when the bottle is seated within the beverage glass.

33. The combination of claim 28, wherein the lower base includes an upstanding punt surrounded by a recessed annular moat circumscribing a relatively flat central component having a smooth inner surface and the bottle includes a cap selectively engaged to and closing the pour spout, the cap having a relatively flat-topped configuration for flush seating within the flat central component.

34. The combination of claim 28, wherein the bottle includes a step that selectively engages the smooth upper rim to terminate slide-in engagement of the bottle into the beverage glass.

35. The combination of claim 28, wherein the bottle includes a notch comprising a wall thickness approximately the same thickness as the rest of the bottle.

* * * * *